US012195981B2

(12) United States Patent
White

(10) Patent No.: US 12,195,981 B2
(45) Date of Patent: Jan. 14, 2025

(54) ANCHOR

(71) Applicant: GRIPPLE LIMITED, Sheffield (GB)

(72) Inventor: Samuel White, Sheffield (GB)

(73) Assignee: GRIPPLE LIMITED (GB)

( * ) Notice: Subject to any disclaimer, the term of this patent is extended or adjusted under 35 U.S.C. 154(b) by 0 days.

(21) Appl. No.: 17/913,530

(22) PCT Filed: Mar. 29, 2021

(86) PCT No.: PCT/IB2021/052571
§ 371 (c)(1),
(2) Date: Sep. 22, 2022

(87) PCT Pub. No.: WO2021/205278
PCT Pub. Date: Oct. 14, 2021

(65) Prior Publication Data

US 2023/0107259 A1 Apr. 6, 2023

(30) Foreign Application Priority Data

| | | |
|---|---|---|
| Apr. 9, 2020 | (GB) | 2005303 |
| Mar. 25, 2021 | (GB) | 2104195 |
| Mar. 26, 2021 | (GB) | 2104285 |

(51) Int. Cl.
*F16L 3/00* (2006.01)
*E04G 15/04* (2006.01)

(52) U.S. Cl.
CPC ..... *E04G 15/04* (2013.01)

(58) Field of Classification Search
CPC ..... E04G 15/04; E04G 21/185; E04C 5/12; E04C 5/16; E04C 5/162; E04B 1/4142; E04B 9/18; E04B 1/41; E04B 1/4114; F16L 3/00; H02G 3/263; H02G 3/30
See application file for complete search history.

(56) References Cited

U.S. PATENT DOCUMENTS

| | | | | |
|---|---|---|---|---|
| 2,199,533 A | | 5/1940 | Wuellner | |
| 3,958,120 A | * | 5/1976 | Ward | G01N 23/18 378/197 |
| 4,678,274 A | * | 7/1987 | Fuller | C30B 33/00 385/128 |
| 4,781,255 A | * | 11/1988 | Lock | H02G 3/0418 174/72 A |
| 5,042,219 A | | 8/1991 | Fricker | |
| 2003/0019169 A1 | | 1/2003 | Francies | |
| 2004/0159070 A1 | | 8/2004 | Hansort | |

(Continued)

FOREIGN PATENT DOCUMENTS

| | | |
|---|---|---|
| DE | 1559420 A1 | 9/1969 |
| DE | 3228817 A1 | 2/1984 |

(Continued)

*Primary Examiner* — Amy J. Sterling
(74) *Attorney, Agent, or Firm* — Clark Hill PLC; James R. Foley

(57) ABSTRACT

An anchor comprises a conduit for receiving a flexible elongate member therethrough. The conduit has an internal region and first and second openings. The flexible elongate member can extend through the first and second openings and through the internal region of the conduit. The conduit is a curved, substantially U-shaped elongate tubular member.

19 Claims, 14 Drawing Sheets

(56) References Cited

U.S. PATENT DOCUMENTS

| | | | | |
|---|---|---|---|---|
| 2005/0062674 | A1* | 3/2005 | Jones | H01Q 1/1242 343/890 |
| 2013/0255170 | A1* | 10/2013 | Millier | E04C 5/08 52/223.13 |
| 2019/0330867 | A1* | 10/2019 | Walsh | E04G 21/3276 |
| 2022/0314045 | A1* | 10/2022 | Ballantyne | A62B 35/0075 |

FOREIGN PATENT DOCUMENTS

| | | | |
|---|---|---|---|
| FR | 2381225 | A1 | 9/1978 |
| WO | 02/44495 | A1 | 6/2002 |

* cited by examiner

ANCHOR

This invention relates to anchors. More particularly, but not exclusively, this invention relates to anchors for use in roofs or ceilings. Embodiments of the invention relate to anchors for suspending articles.

It can be necessary to suspend cable trays or pipes from upper regions of a building, for example the roof or a ceiling. This is often done by passing a cable through a suitable suspension device, itself suspended from the roof or ceiling.

According to one aspect of this invention, there is provided an anchor comprising a conduit for receiving a flexible elongate member therethrough, the conduit having an internal region and first and second openings, wherein the flexible elongate member can extend through the first and second openings and through the internal region of the conduit.

According to another aspect of this invention, there is provided a method of suspending an article, said method comprising: arranging an anchor described above on a support article; disposing a curable material on the support article to cover the anchor; inserting an elongate flexible member through the conduit and attaching the article to the elongate member.

The conduit may be elongate. The conduit may be a tubular member. The conduit may be curved. The tubular member may be a substantially U-shaped member extending around a space. The conduit may be an inverted U-shaped member.

The conduit may have first and second openings through which the elongate member can extend. The first and second openings may be at opposite ends of the conduit. The elongate member may extend out of both openings.

The method may comprise inserting the elongate member through the conduit so that the elongate member extends out of both openings.

The first and second openings may be substantially coplanar with each other.

The anchor may be used in a ceiling. The anchor may be a ceiling anchor. The anchor may be suitable to be embedded in a curable material. The curable material may be poured over the anchor. The curable material may be a curable building material, such as concrete.

The anchor may be formed of a plastics material so that the conduit provides a smooth internal passage to allow the elongate member to move easily through the conduit.

The anchor may define a space between the opposite ends of the conduit. The curable material may be received through the space. An inwardly extending flange portion may extend from the conduit partially across the space.

A rib portion may extend across the space. The rib portion may extend from the flange portion between the opposite ends of the conduit.

In the embodiment described herein, the curable material may be disposed around the anchor to provide strength and form for supporting the elongate member and the load thereon.

The anchor may comprise a fastening formation to fasten the anchor to the support article.

The method may comprise fastening the anchor to the support article using the fastening formation.

The support article may facilitate constructing the building. The fastening formation may be attached to the conduit.

The support article may comprise shuttering. The shuttering may comprise wooden shuttering or metal decking.

The fastening formation may extend outwardly from the conduit. Alternatively, the fastening formation may extend inwardly from the conduit. In this alternative, the fastening formation may extend along the rib portion.

The fastening formation may define an aperture to receive a fastener therethrough. The fastening formation may comprise a projection. The projection may comprise a web member. The projection may define the aforesaid aperture.

The projection may be attached to the rib portion. The projection may extend along the rib portion.

The fastening formation may comprise a raised member. The raised member may have a through bore. The raised member may extend from the projection.

The aperture may provide an opening for the bore. The fastener may extend through the bore. The projection may connect the raised formation to the conduit. The projection may connect the raised formation to the rib portion. The fastener may be a screw, nail or the like.

The method may comprise inserting the fastener through the aperture into the support article.

The anchor may comprise two of said fastening formations.

The method may comprise fastening the anchor to the support article by means of both fastening formations.

The fastening formations may be attached to the conduit opposite each other.

Each fastening formation may be attached to the conduit at a respective opposite end of the conduit. Each fastening formation may be attached to the conduit at a respective one of the aforesaid first and second openings.

The method may comprise inserting a respective fastener through each aperture into the support article.

The anchor may comprise a bracing member to brace the conduit. The bracing members may brace the anchor in an upright position.

The bracing member may extend from the conduit. The bracing member may extend between the conduit and the rib portion. The bracing member may be attached to a central region of the rib portion.

The bracing member may extend to the central region of the conduit. The bracing member may extend transversely from the conduit. The bracing member may extend perpendicularly from the conduit.

The bracing member may comprise an engaging portion. The engaging portion may be substantially coplanar with the openings.

The engaging portion may be arranged to engage the aforesaid support article. The bracing member may thereby maintain the anchor in an upright position on the aforesaid support article.

The bracing member may be arranged on the conduit between the ends of the conduit.

The bracing member may comprise a substantially triangular main portion. The main portion may be attached to the conduit.

The bracing member may extend across the aforesaid space. The bracing member may extend from the flange portion to the rib portion.

The triangular main portion may have a first apex attached to the conduit. Each triangular main portion may have a second apex. The second apex may be attached to the rib portion.

The main portion may extend across the space from the first apex to the second apex.

The main portion may have a third apex. The third apex may be spaced from the second apex.

The main portion may extend from the second apex to the third apex.

The bracing member may comprise a foot portion extending from the main portion to said region substantially coplanar with the first and second openings.

The bracing member may comprise two of the aforesaid foot portions. A first of the foot portions may extend from the third apex.

A second of the foot portions may extend from the second apex. The second foot portion may extend along the rib portion.

The anchor may comprise two of the bracing members. The bracing members may be arranged opposite each other. The bracing members may extend in opposite directions from the conduit.

Alternatively, the bracing member may extend from a central region of the rib portion diagonally outwardly to the conduit. The bracing member may comprise a spoke member.

The anchor may comprise two of the bracing members. The bracing members may be arranged in a V shaped formation.

The anchor may comprise extension members. The extension members may extend from the conduit. Each extension member may extend from a respective one of the first and second openings.

Each extension member may define a cavity, the cavity being in communication with the internal region of the conduit. Said communication may be via the first or the second opening.

The anchor may further include securing formations on the extension members for securing the anchor to the support article. The securing formations may comprise snap fit formations.

The method may comprise mounting the anchor on the support article by forming first and second holes in the support article. The extension members may be inserted through the holes when the anchor is arranged on the support article.

The securing formations may be provided on the extension members. The securing formations may engage the underside of the support article to secure the anchor to the support article.

The elongate member may be inserted into the conduit via one of the extension members. When the elongate member is fully threaded through the anchor, the elongate member may extend through both of the extension members.

Alternatively, the extension members may be detached before inserting the elongate member into the anchor.

The anchor may comprise a first anchor portion and a second anchor portion. Each of the anchor portions may comprise an elongate portion of the conduit. The method may comprise attaching the first and second anchor portions to each other.

Each of the first and second anchor portions may comprise a half portion. Each of the anchor portions may comprise an elongate half portion of the conduit.

An embodiment of the invention will now be described by way of example only, with reference to the accompanying drawings, in which.

The drawings show an anchor 10 suitable for use in ceilings formed using shuttering 32 in the form of wooden boards, but can also be used in ceilings formed using shuttering 32 in the form of metal decking.

The anchor 10 comprises a conduit 12 in the form of a tubular inverted U shaped member extending around a space 15. In the embodiment shown, the anchor 10 is a ceiling anchor.

Figure 1:
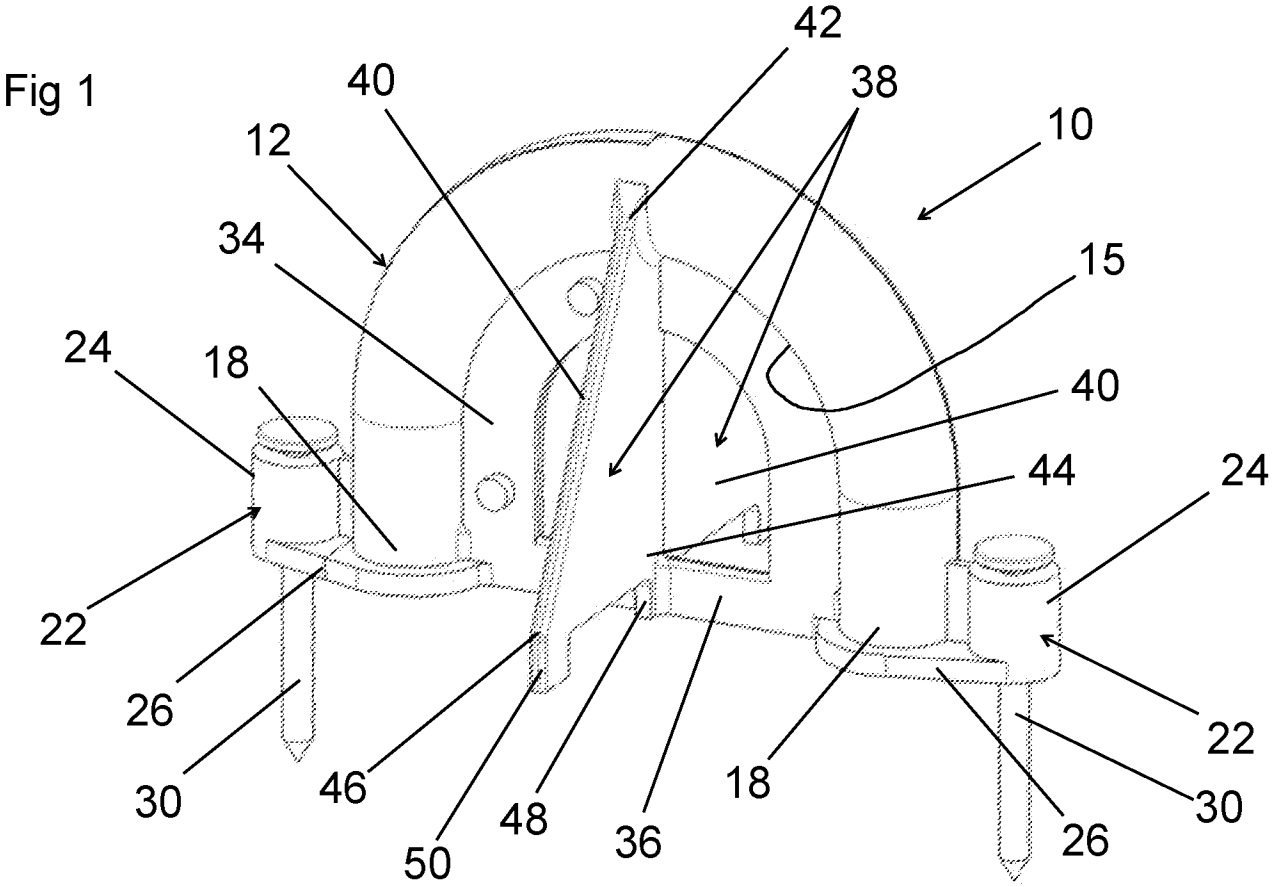
FIG. 1 is a perspective view from one direction of an anchor.
Figure 2:
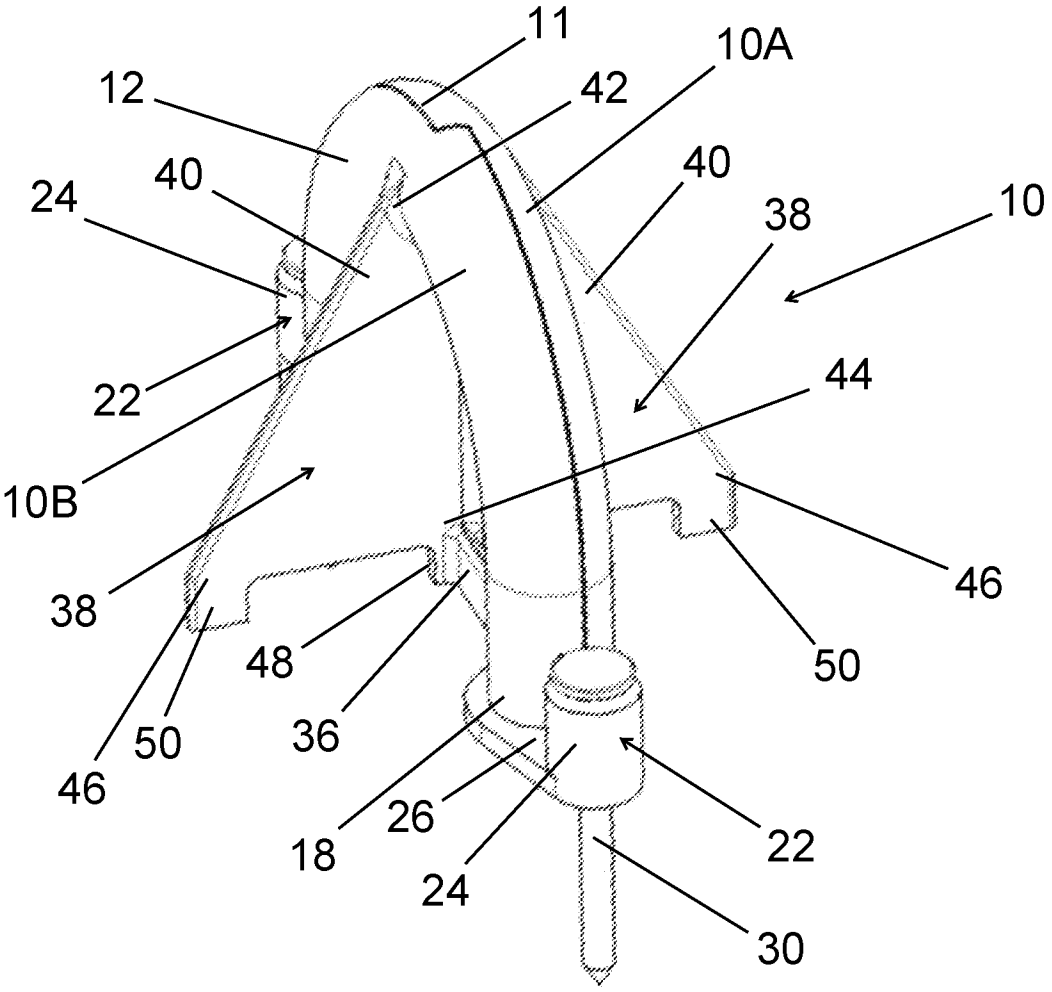
FIG. 2 is a perspective view from another direction of the anchor.

In the embodiment shown in the drawings, the anchor 10 is formed of two halves 10A, 10B as shown by a line 11 (see FIG. 2) indicating the joining of the two halves 10A, 10B.

The formation of the anchor in two halves is carried out for manufacturing expediency. The skilled person would realise that the anchor 10 could be formed as a one-piece unit by appropriate manufacturing techniques.

Figure 3:
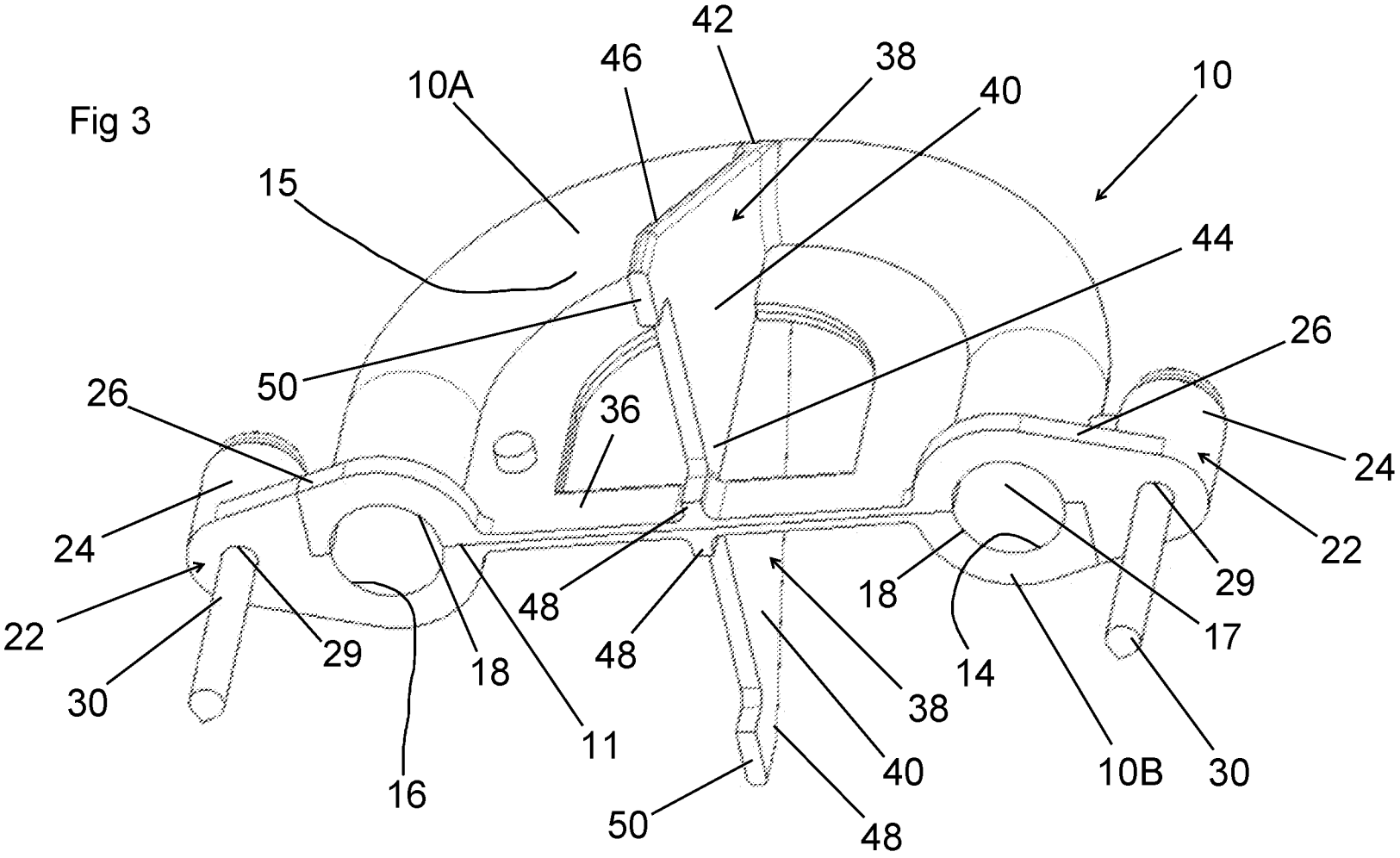
FIG. 3 is a perspective view from below of the anchor.
Figure 4:
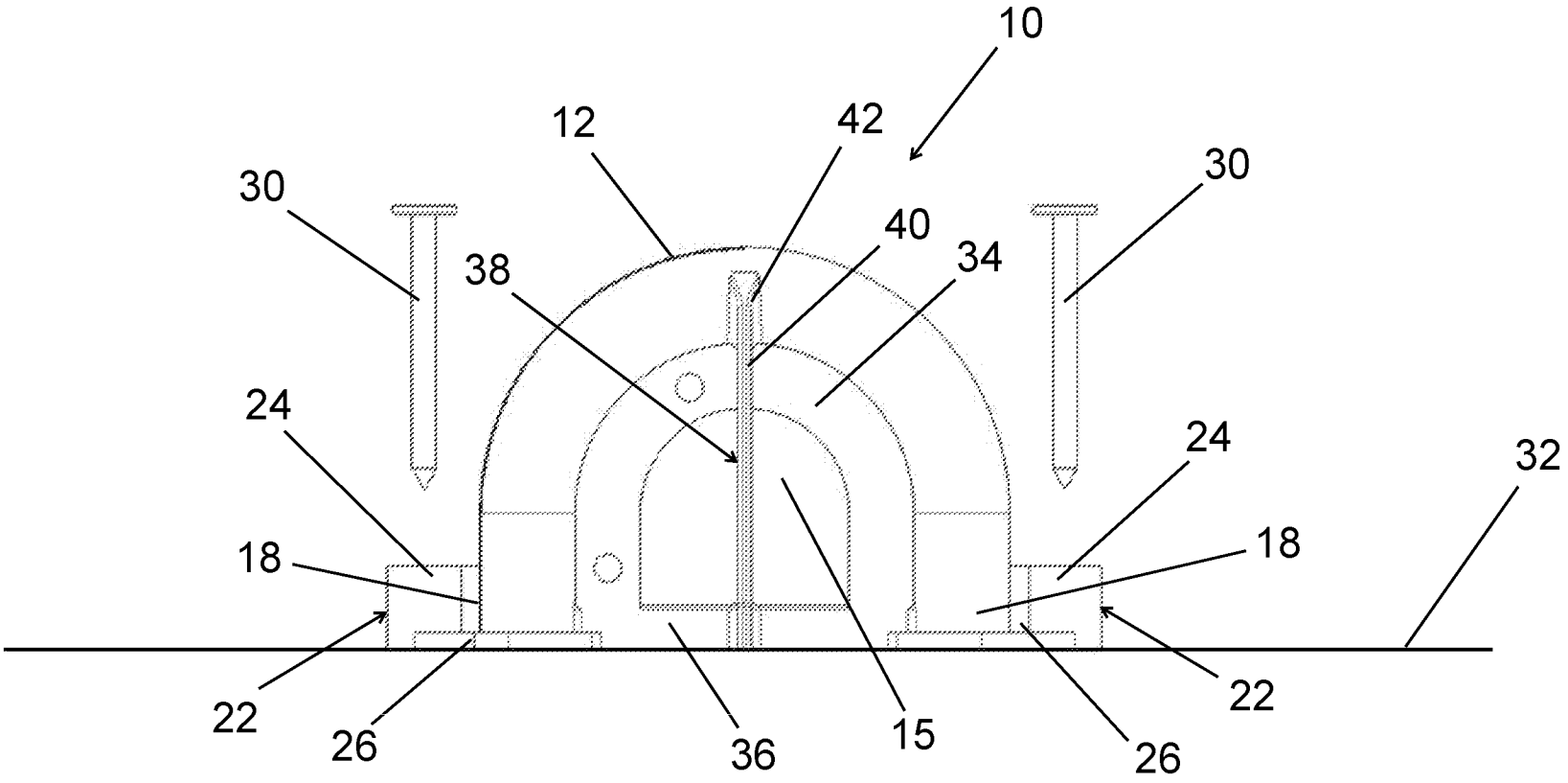
FIG. 4 is a side view of the anchor being fastened to a support article.
Figure 5:
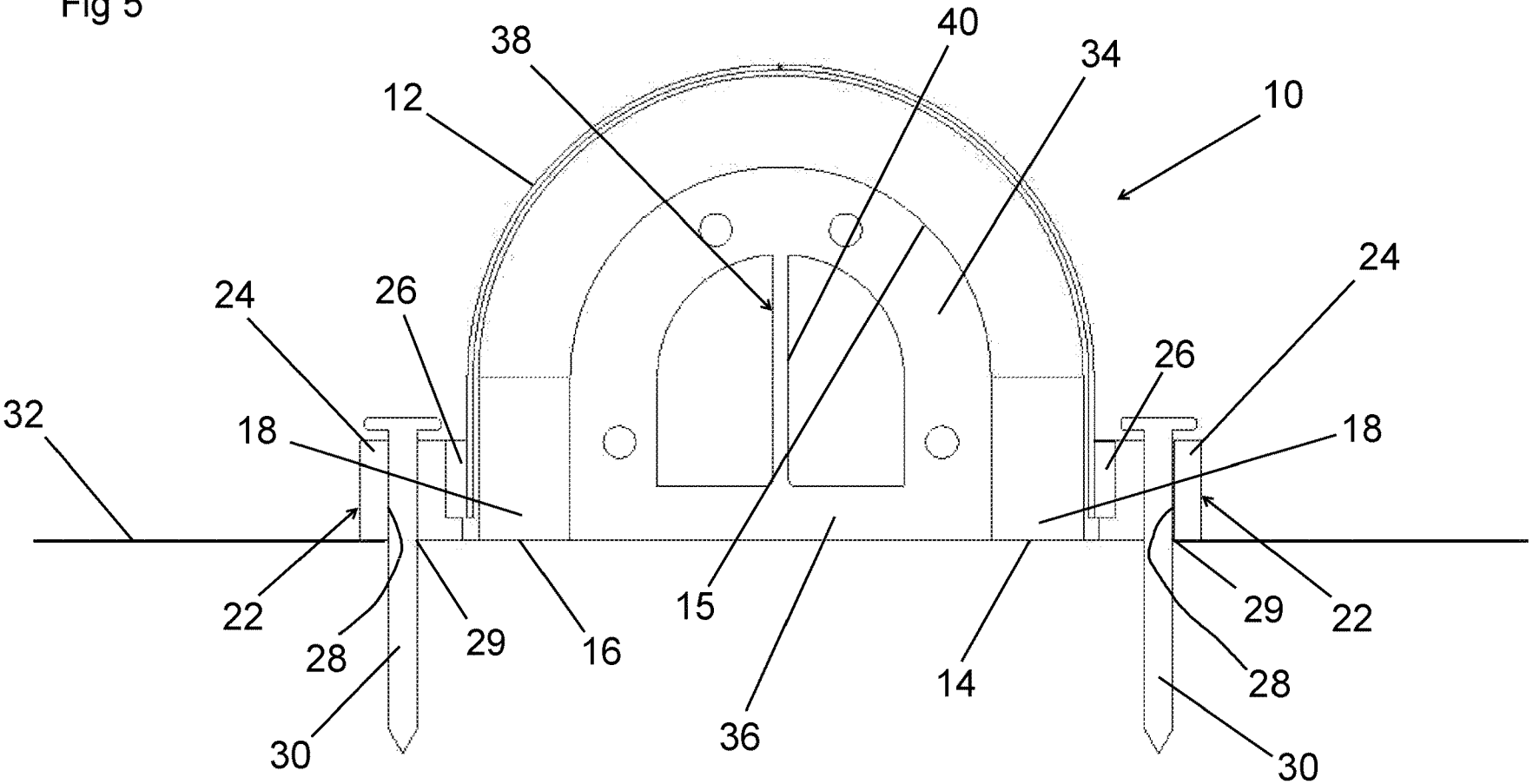
FIG. 5 is a sectional side view of the anchor fastened to the support article.

The conduit 12 defines an empty internal region 17, and first and second openings 14, 16 for the internal region 17 at the opposite ends 18 of the conduit 12 (see FIG. 3). The first and second openings 14, 16 are substantially coplanar with each other.

As explained in more detail below, the conduit 12 can receive a flexible elongate member 20, e.g. a cable, through it so that the elongate member 20 extends from both of the first and second openings 14, 16.

The anchor 10 further includes two fastening formations 22 attached to the conduit 12 at the first and second openings 14, 16. The fastening formations 22 extend diametrically outwardly from the conduit 12 in opposite directions.

Each fastening formation 22 comprises a raised member 24 and a respective projection in the form of a web member 26 extending between each raised member 24 and the conduit 12, each raised member 24 extending from a respective one of the web members 26.

The web members 26 extend radially outwardly in diametrically opposite directions from the respective opposite ends 18 of the conduit 12.

Each raised member 24 defines a bore 28 through which a fastener 30, such as a nail or a screw, can be inserted to fasten the anchor 10 to a support article. Each web member 26 defines an aperture 29 providing an opening for the bore 28.

The support article comprises shuttering 32 upon which a curable material in the form of concrete can be poured to form a ceiling. The shuttering 32 is in the form of wooden shuttering or metal decking.

The anchor 10 includes an inwardly extending flange portion 34 on the conduit 12. The flange portion 34 extends from the conduit 12 partially across the space 15, and extends along the conduit 12 from one end 18 of the conduit 12 to the opposite end 18.

A rib portion 36 extends across the space 15 between the opposite ends 18 of the conduit 12.

The anchor 10 also includes two bracing members 38 attached to the conduit 12. The bracing members 38 are arranged on opposite sides of the anchor 10, and extend perpendicularly from the conduit 12 and the flange portion 34 in opposite directions.

Each bracing member 38 comprises a triangular main portion 40 having a first apex 42 attached to the conduit 12.

The main portion 40 extends across the space 15 to a second apex 44 attached to the rib portion 36. The main portion 40 extends from the rib portion 36 to a third apex 46 spaced from the rib portion 36.

Each bracing member 38 includes an engaging portion in the form of a first foot portion 48 extending downwardly from the second apex 44 across the rib portion 36. The first foot portion 48 is attached to the main portion 40 at the second apex 44, and attached to the rib portion 36.

Each bracing member 38 further includes a further engaging portion in the form of a second foot portion 50 extending downwardly from the main portion 40. The second foot portion 50 is attached to the main portion 40 at the third apex 46.

Each of the first and second foot portions 48, 50 extends from main portion 40 to terminate substantially coplanar with the opposite ends 18 of the conduit 12. The first and second foot portions 48, 50 engage the shuttering 32 to maintain the anchor 10 in an upright position.

In use, during the construction of a ceiling the shuttering 32 is laid across the region in which the ceiling is to be constructed. One or more of the anchors 10 are then fastened to the shuttering 32.

Where the shuttering 32 is in the form of metal boards, holes are drilled through the shuttering 32 before fastening the anchors 10 thereto. The holes are spaced from each other by a distance that is the same as the distance between the first and second openings 14, 16.

The anchors 10 are then fastened to the shuttering 32 over the hole so that the first and second openings 14, 16 defined at the opposite ends 18 of the conduit 12 are aligned with the holes.

The anchors 10 are fastened to the shuttering 32 by inserting the fasteners 30 through the apertures 28 in the fastening formations 22 and then driving the fasteners 30 into the shuttering 32. The anchors 10 are thus fastened to the shuttering 32 in an upright position.

When each anchor 10 is so fastened, the first and second foot portions 48, 50 engage the shuttering 32. Thus, the shuttering 32 is engaged by the fastening formations 22 and the first and second foot portions 48, 50.

This has the effect of preventing the anchors 10 being kicked over if a workman trips over one or more of them while working, or if materials are dragged over the anchors 10 during construction.

Figure 6:
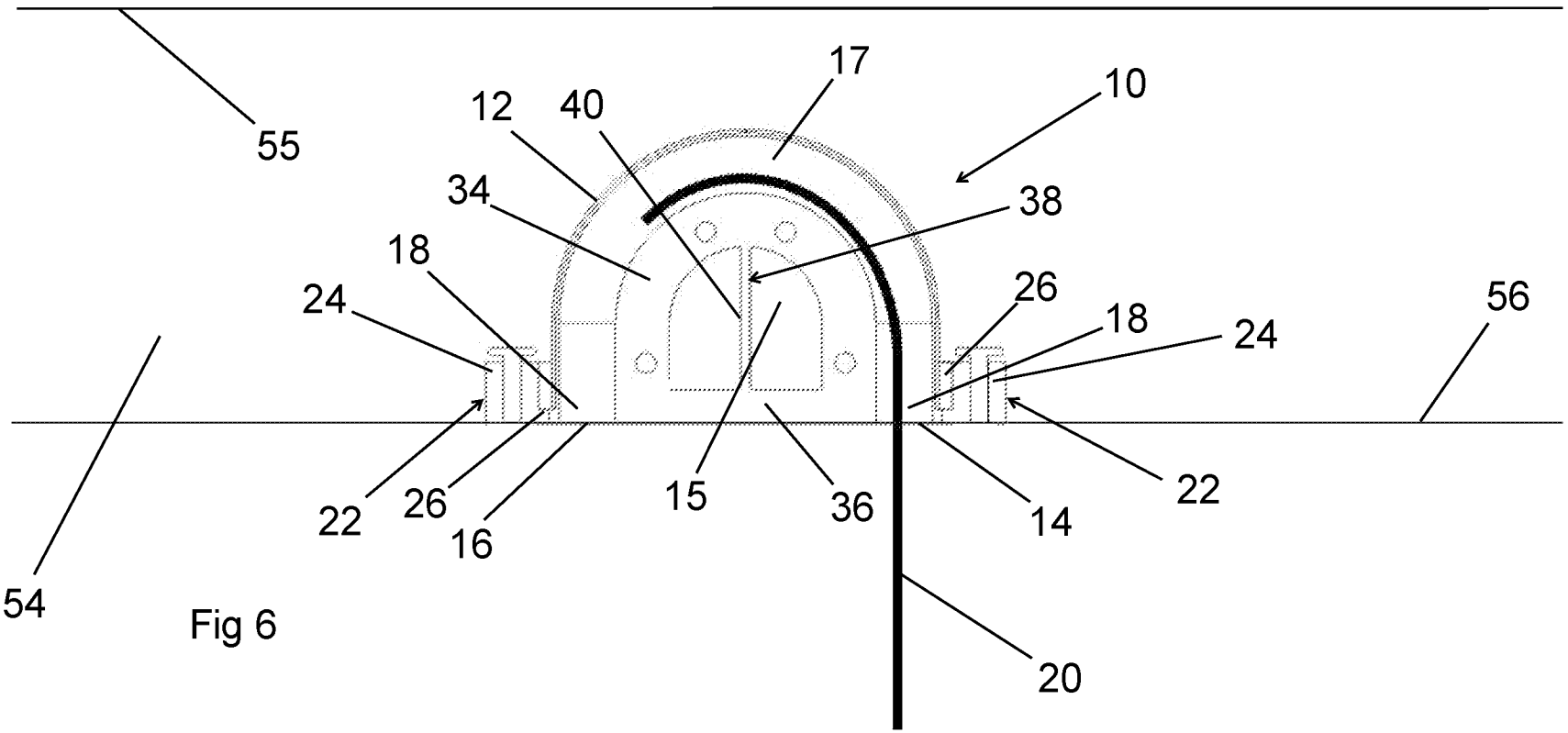
FIG. 6 is a view similar to FIG. 5, showing a flexible elongate member being inserted into a conduit.
Figure 7:
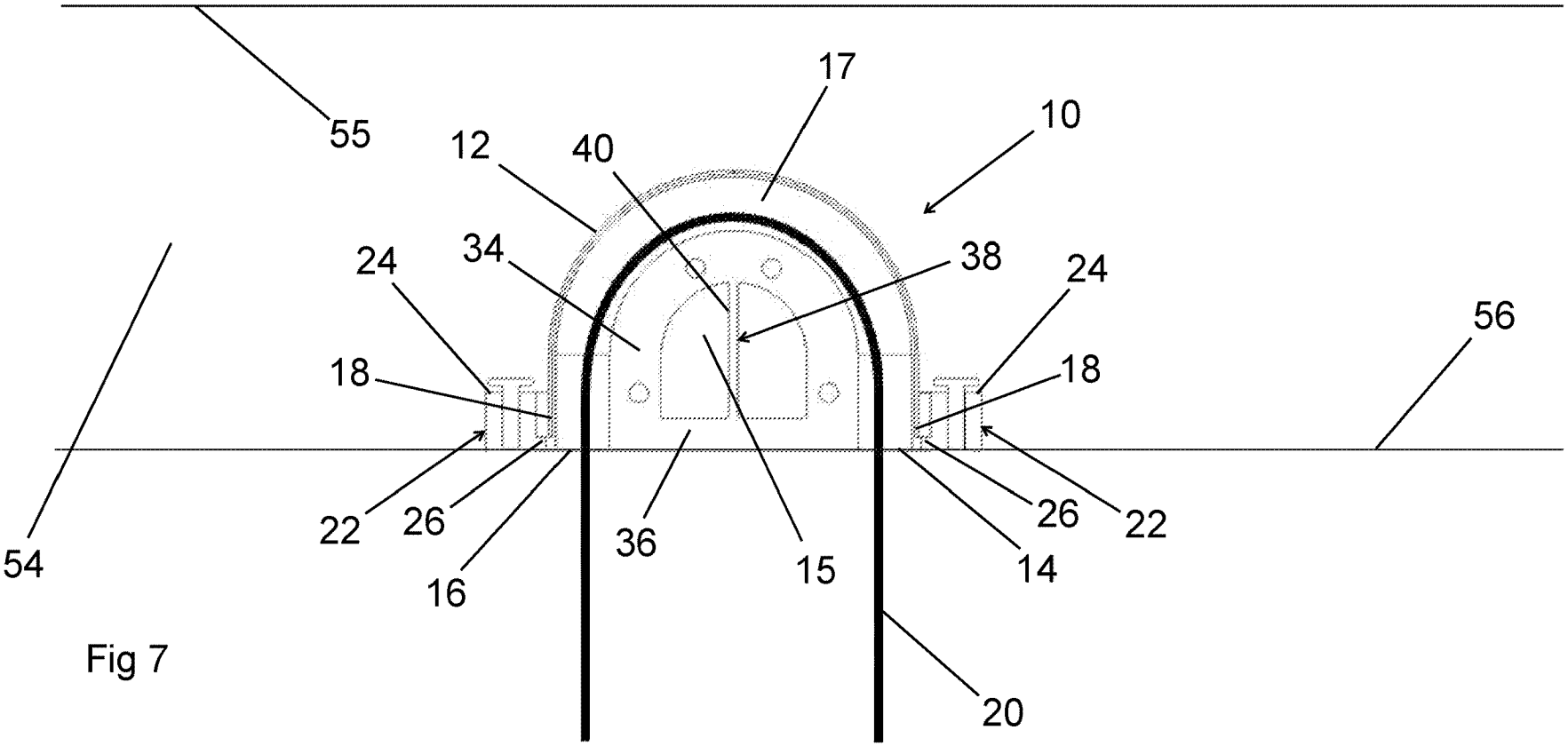
FIG. 7 is a view similar to FIG. 6, showing the flexible elongate member after insertion into the conduit.
Figure 8:
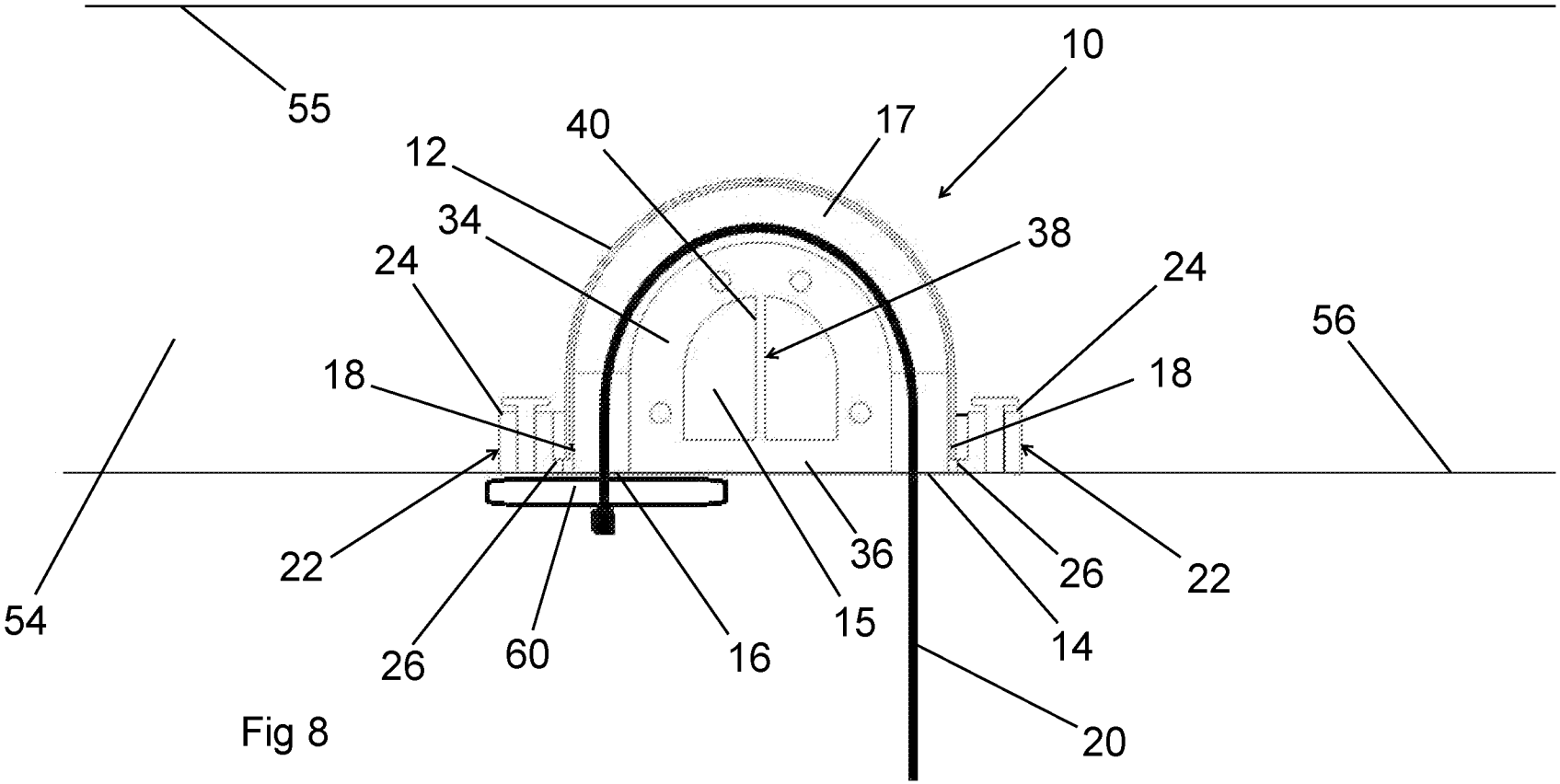
FIG. 8 is a view similar to FIG. 7 showing one way of holding the flexible elongate member in the conduit.

Concrete is then poured over the shuttering 32 to a desired depth, covering the anchors 10 fastened to the shuttering 32 to form a ceiling 54 (see FIGS. 6, 7 and 8).

The line 55 indicates the depth of the concrete. While the concrete is being poured, it flows around the conduit 12 and through the space 15.

When the concrete has cured, shuttering 32 in the form of wooden boards is removed, revealing the first and second openings 14, 16 at the opposite ends 18 of the conduit 12 of each anchor 10 at the lower surface 56 of the ceiling 54.

In the case of shuttering 32 in the form of metal boards, the shuttering 32 is left in place. The tips of the fasteners 30 can be removed so that they do not protrude from the lower surface 56 of the concrete.

Referring to FIGS. 6 and 7, one end of a flexible elongate member 20 is then inserted into the conduit 12 via the first opening 14. In the case of shuttering 32 in the form of metal boards, the flexible elongate member 20 passes through the holes in the shuttering.

The flexible elongate member 20 is threaded through the conduit 12 until the end of the flexible elongate member 20 exits the conduit 12 via the second opening 16, thereby forming two passes extending from the conduit 12.

A loop can be formed in the flexible elongate member 20, and the two passes can be connected to each other, allowing an article, for example a pipe or a cable tray, to be attached to the flexible elongate member 20 by suitable means known in the art.

Alternatively, as shown in FIG. 8, a toggle 60 or similar member, such as a crimped member, could be attached to one end of the flexible elongate member 20.

The other end of the flexible elongate member 20 can then be pulled until the toggle 60 engages the lower surface 56 of the concrete 54, the toggle 60 thereby holding the flexible elongate member 20 in the conduit 12.

There is thus described an anchor 10 that can be embedded in a ceiling. A flexible elongate member 20, such as a cable, can be threaded through the anchor 10 allowing the cable to extend directly from the ceiling, without the need for intermediary connectors, such as threaded rods, or connecting devices.

Various modifications can be made without departing from the scope of the invention.

Figure 9:
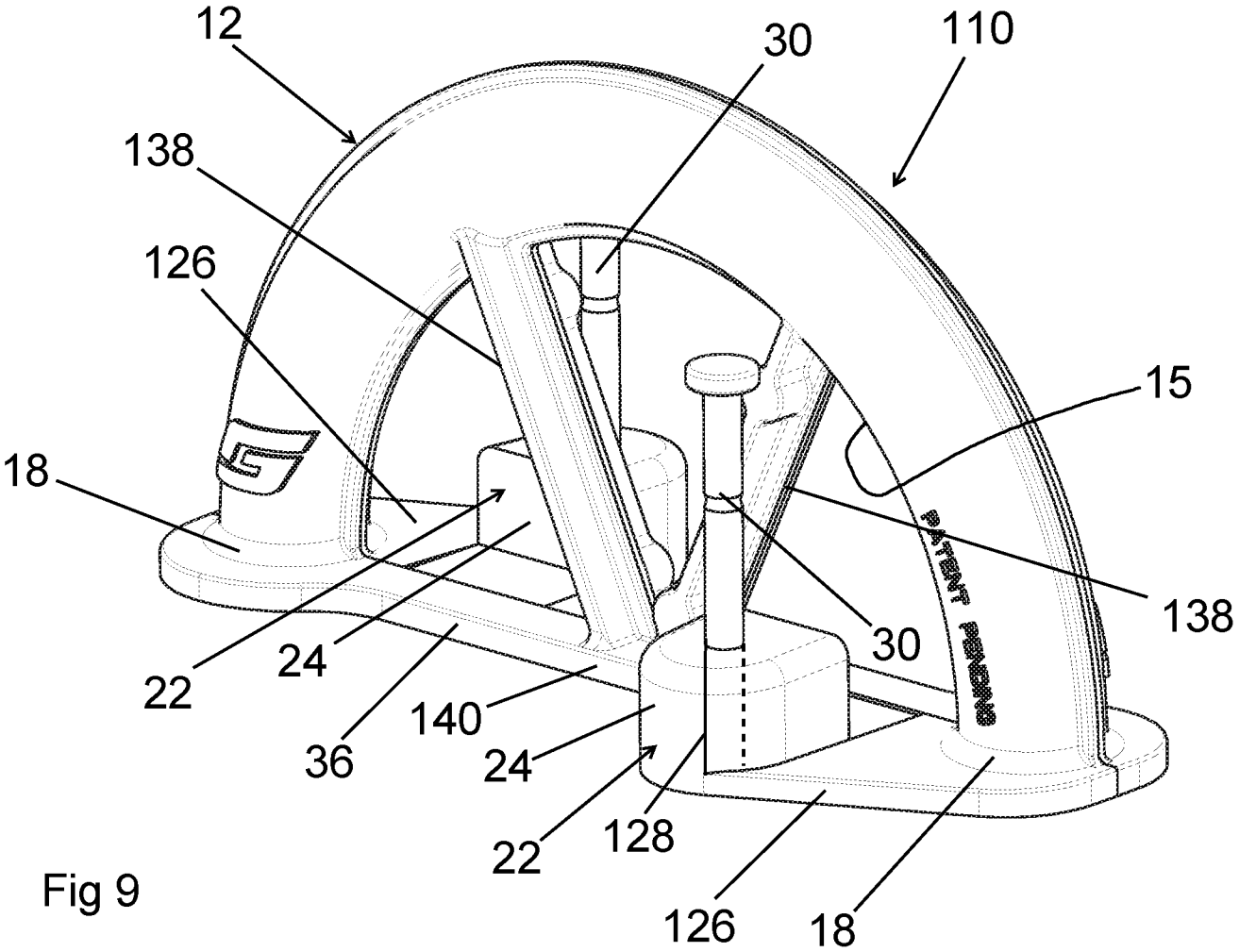
FIG. 9 is a perspective view from above of a further anchor.
Figure 10:
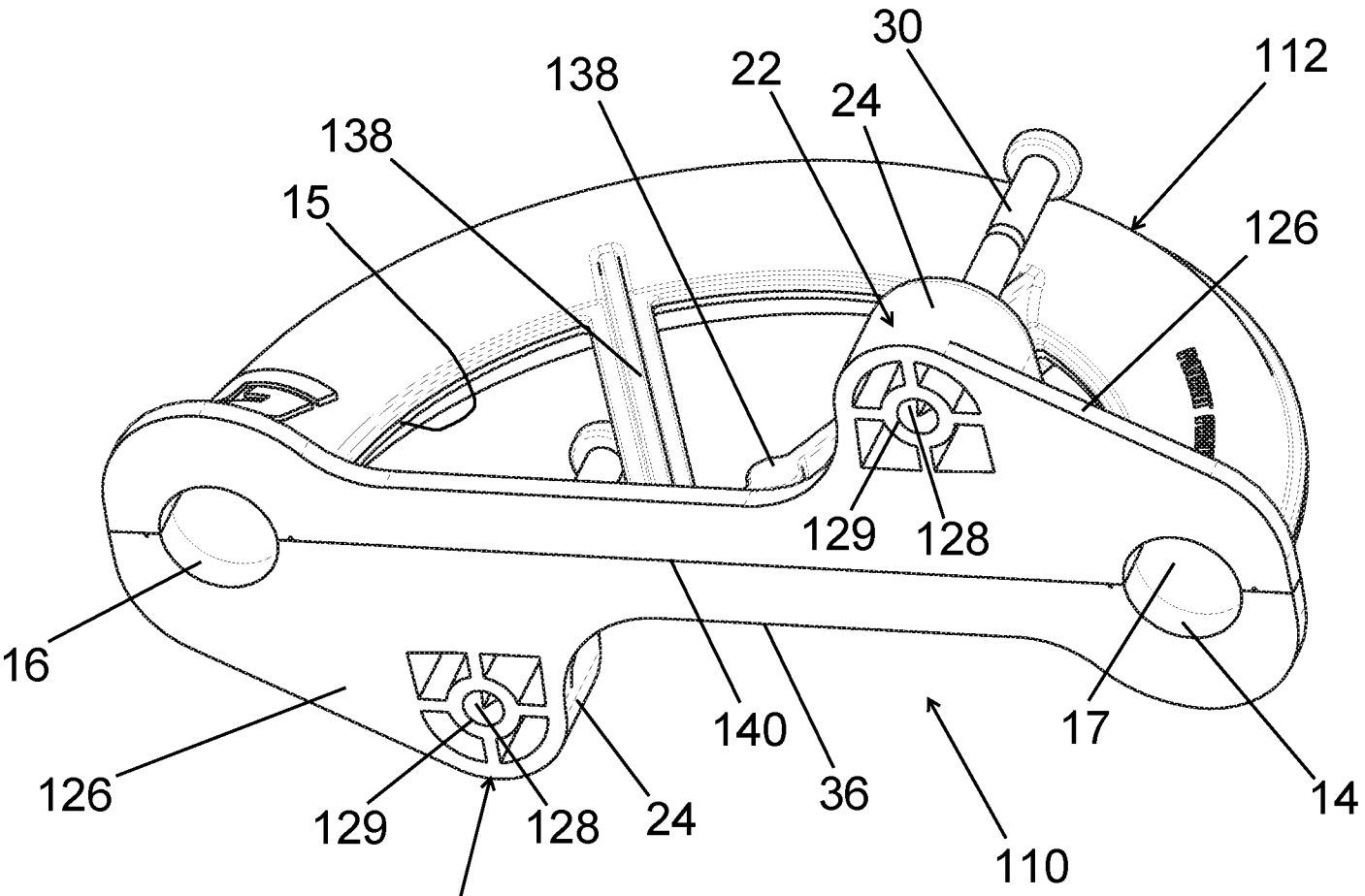
FIG. 10 is a perspective view from below of the further anchor shown in FIG. 9.
Figure 11:
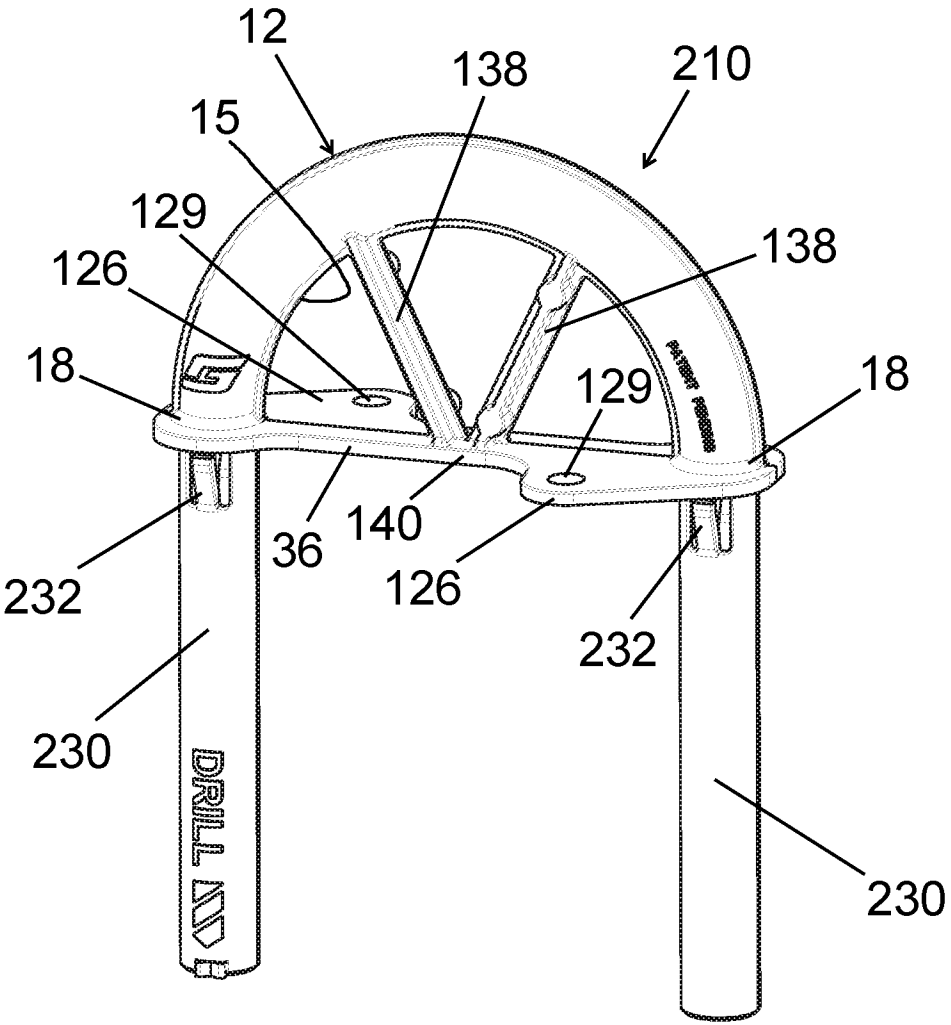
FIG. 11 is a perspective view of another article.

FIGS. 9 and 10 show a further anchor, generally designated 110. The anchor 110 comprises many of the features of the anchor 10. These features have been designated with the same reference numerals as the corresponding features shown in FIGS. 1 to 8.

The anchor 110 differs from the anchor 10 in that the bracing members 38 are replaced by spoke members 138. The spoke members 138 extend from a central region 140 (see FIG. 10) of the rib portion 36 diagonally outwardly to the conduit 12. The spoke members 138 are arranged in a V shaped formation, providing bracing to the conduit 12.

The fastening formations 22 comprise the raised members 24 and web members 126. The web members 126 extend inwardly towards each other from the respective ends 18 of the conduit 12. In addition, the web members 126 are attached to and extend along the rib portion 36 on opposite sides thereof.

The raised members 24 are provided on the web members 126, on opposite sides of the rib portion 36. The raised members 24 have a bore 128 (shown in broken lines in FIG. 9) through which the fasteners 30 extend. Each web member 126 defines an aperture 129 providing an opening for the bore 128.

By arranging the fastening formations 22 inwardly of the ends 18 of the conduit 12, the anchor 110 shown in FIG. 9 is made more compact than the anchor 10 shown in FIGS. 1 to 8.

Another anchor, generally designated 210, is shown in FIGS. 11 to 14. The anchor 210 is particularly suitable for use in ceilings formed using shuttering 32 in the form of metal decking.

The anchor 210 comprises many of the features of the anchor 110. These features have been designated with the same reference numerals as the corresponding features shown in FIGS. 9 and 10.

The anchor 210 differs from the anchor 110 in that the fastening formations are devoid of raised formations, being simply in the form of the web members 126 defining the apertures 129.

A further difference between the anchor 210 and the anchor 110 is that the anchor 210 comprises tubular extension members 230 extending from the conduit 12 at each of the openings 14, 16.

Each extension member 230 defines a cavity 231 in communication with the internal region 17 of the conduit, said communication being via the first or the second opening 14, 16.

The anchor 210 further includes snap fit formations 232 on the extension members 230. The snap fit formations 232 to secure the anchor 210 to the shuttering 32, as explained below.

Figure 12:
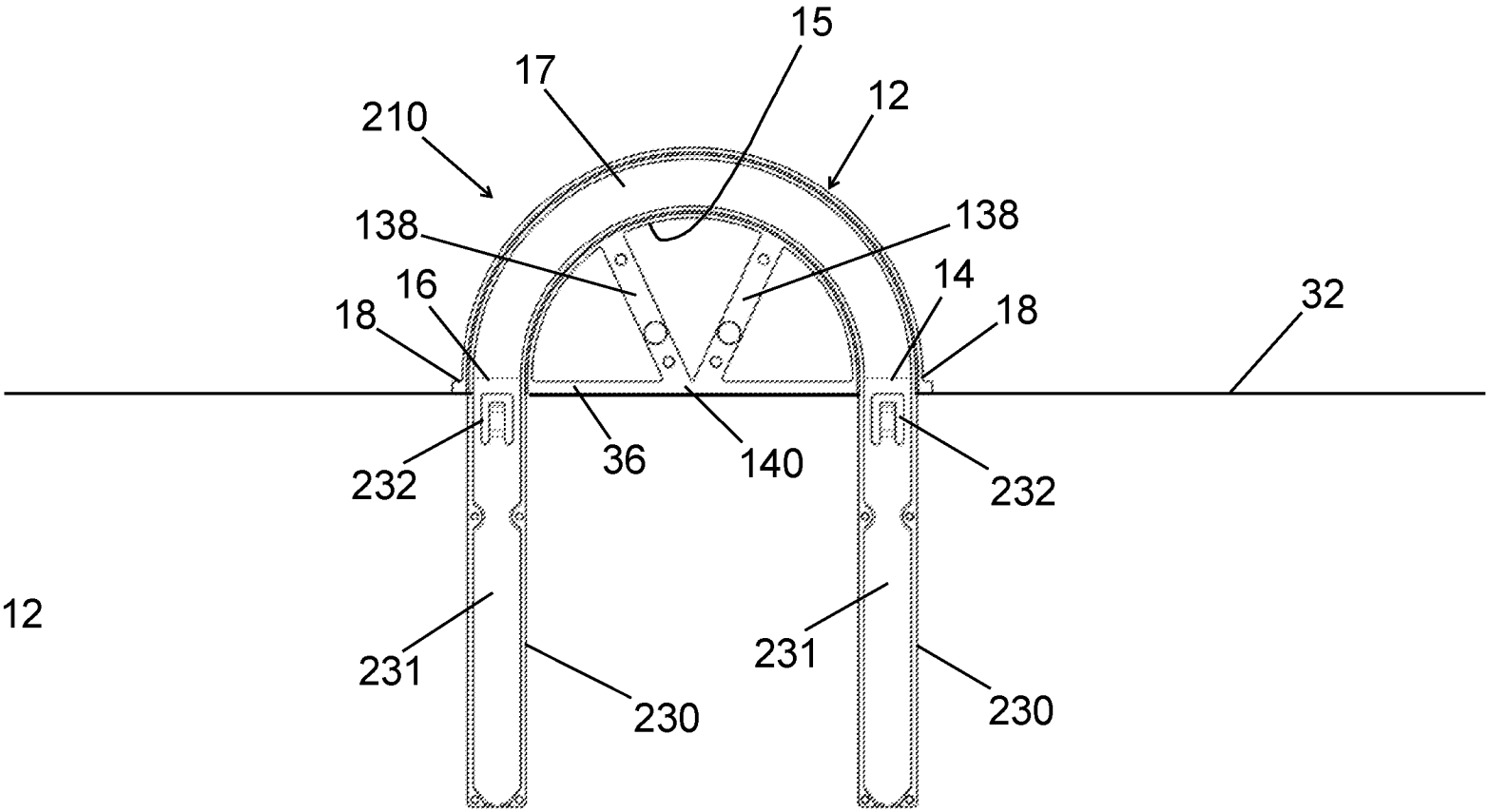
FIG. 12 is a sectional front view showing the other anchor mounted on the support article.
Figure 13:
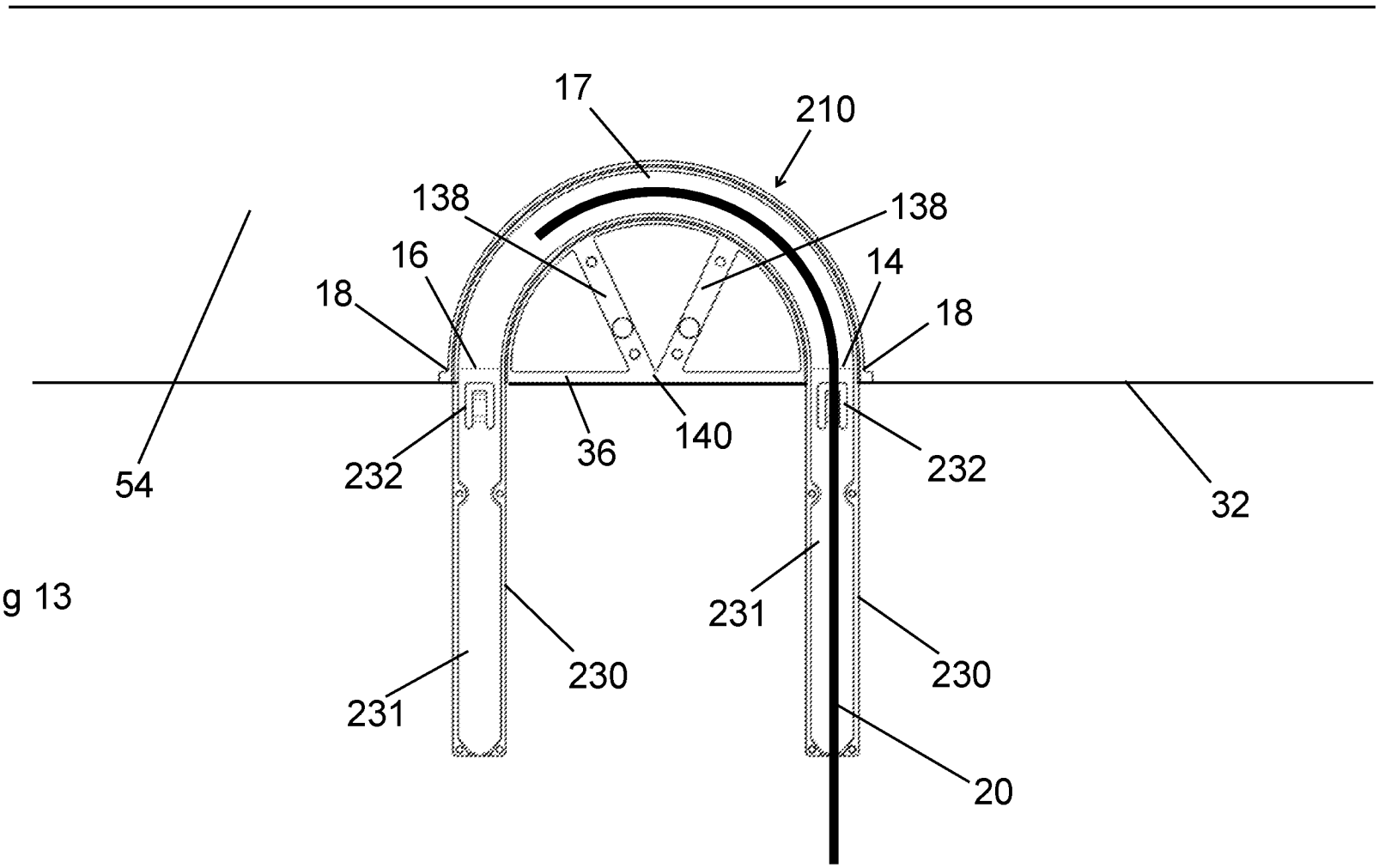
FIG. 13 is a view similar to FIG. 12, but showing an elongate member being inserted through said other anchor.
Figure 14:
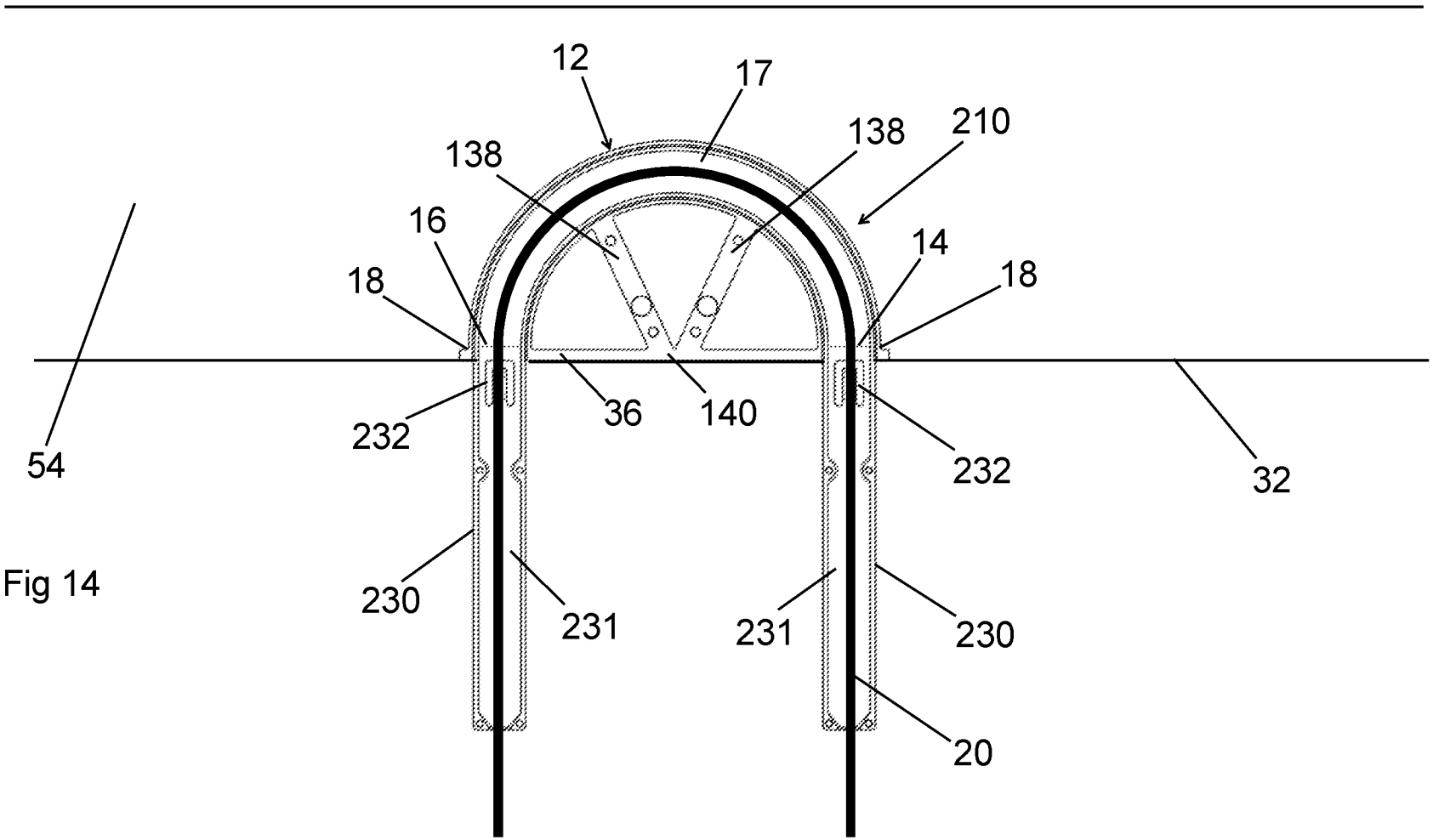
FIG. 14 is a view similar to FIGS. 12 and 13, but showing the elongate member having been inserted through said other anchor.

The anchor 210 may be mounted on the shuttering 32 in the form of metal decking, represented schematically in FIGS. 12 to 14. Two holes are drilled into the shuttering 32.

The holes are spaced from each other by a distance that is the same as the distance between the first and second openings 14, 16.

The anchor 210 is arranged on the shuttering 32 with the extension members 230 inserted through the holes, as shown in FIG. 12. The snap fit formations 232 engage the underside of the shuttering 32 to secure the anchor 210 to the shuttering 32.

Fasteners in the form of screws are inserted through the apertures 129 and screwed into the shuttering 32 thereby fastening the anchor 210 to the shuttering 32.

Concrete is then poured over the shuttering 32 covering the anchor 210 to form the ceiling. When the concrete has cured, if desired, a fire retardant may be sprayed over the underside of the shuttering 32.

The elongate member 20 is then threaded through the anchor 210 by being inserted into one of the extension members 230, then threaded through the conduit 12, and then through the other extension member 230.

When fully threaded through the anchor 210, an article can be attached to the elongate member 20 in the same way as described above.

If desired, the extension members 230 may be removed after the concrete has cured, and before the elongate member 20 is threaded through the anchor 210.

The invention claimed is:

1. An anchor comprising: a conduit for receiving a flexible elongate member therethrough, wherein the conduit is a curved, substantially U-shaped elongate tubular member, the conduit having an internal region, an external surface, and first and second openings; wherein the flexible elongate member can extend through the first and second openings and through the internal region of the conduit; wherein the anchor comprises a rib portion extending from said external surface across the conduit, and wherein the rib portion and said external surface define a space therebetween.

2. An anchor according to claim 1, wherein the first and second openings are defined at opposite ends of the conduit, and the elongate member can extend through both of the first and second openings.

3. An anchor according to claim 1, wherein the space is defined between the opposite ends of the conduit, and wherein a curable material is receivable through the space.

4. An anchor according to claim 3, wherein the rib portion extends across the space between the opposite ends of the conduit.

5. An anchor comprising a conduit for receiving a flexible elongate member therethrough, the conduit having an internal region and first and second openings; wherein the flexible elongate member can extend through the first and second openings and through the internal region of the conduit; and a rib portion extending between the opposite ends of the conduit wherein a space is defined between the conduit and the rib portion, and wherein a curable material is receivable through the space; and the anchor further comprises a bracing member to brace the conduit in an upright position, the bracing member extending between the conduit and the rib portion.

6. An anchor according to claim 5, wherein the bracing member is attached to a central region of the rib portion, the bracing member extending from the central region of the rib portion diagonally outwardly to the conduit.

7. An anchor according to claim 5, comprising two of the bracing members, said bracing members being arranged in a V-shaped formation.

8. An anchor according to claim 4, comprising a fastening formation to fasten the anchor to the support article, the fastening formation extending along the rib portion.

9. An anchor according to claim 8, wherein the fastening formation comprises a projection defining an aperture to receive a fastener therethrough.

10. An anchor according to claim 9, wherein the fastening formation comprises a raised member having a through bore, the raised member extending from the projection, and the aperture providing an opening for the bore, and wherein the projection connects the raised formation to the conduit.

11. An anchor according to claim 9, wherein the projection is attached to, and extends along, the rib portion.

12. An anchor according to claim 8, comprising two of said fastening formations, the fastening formations being attached to the conduit at respective opposite ends of the conduit.

13. An anchor according to claim 1, comprising first and second extension members extending from the conduit, each extension member extending from a respective one of the first and second openings.

14. An anchor according to claim 13, wherein each of the first and second extension members comprises a respective tubular member defining a hollow communicating with the internal region of the conduit.

15. An anchor according to claim 13, further including securing formations on the extension members for securing the anchor to the support article, the securing formations being engageable with the underside of the support article to secure the anchor to the support article.

16. A method of suspending an article, said method comprising: providing an anchor comprising a conduit for receiving a flexible elongate member therethrough, the conduit having an internal region and first and second openings, wherein the flexible elongate member can extend through the first and second openings and through the internal region of the conduit; arranging the anchor on a support article in an upright condition, whereby the first and second openings face downwardly; disposing a curable material on the support article to cover the anchor; inserting a flexible elongate member through the conduit and attaching the article to the elongate member.

17. A method according to claim 16, wherein the first and second openings are defined at opposite ends of the conduit, and the step of inserting the elongate member comprises inserting the elongate member through the conduit so that the elongate member extends out of both openings.

18. A method according to claim 16, wherein the anchor comprises a fastening formation to fasten the anchor to the support article, and the step of arranging the article on the support article comprises fastening the anchor to the support article using the fastening formation.

19. A method according to claim 18, wherein the fastening formation comprises a projection defining an aperture to receive a fastener therethrough, and the step of fastening the anchor to the support article comprises inserting a respective fastener through each aperture into the support article.

* * * * *